US008105180B1

(12) United States Patent
Cackett et al.

(10) Patent No.: US 8,105,180 B1
(45) Date of Patent: Jan. 31, 2012

(54) IRON-TYPE GOLF CLUB HEAD WITH GROOVE PROFILE IN CERAMIC FACE

(75) Inventors: Matthew T. Cackett, San Diego, CA (US); Augustin W. Rollinson, Carlsbad, CA (US); Alan Hocknell, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 20 days.

(21) Appl. No.: 12/827,880

(22) Filed: Jun. 30, 2010

Related U.S. Application Data

(60) Provisional application No. 61/224,821, filed on Jul. 10, 2009.

(51) Int. Cl.
*A63B 53/04* (2006.01)

(52) U.S. Cl. ..... 473/330; 473/331

(58) Field of Classification Search ..... 473/324–350, 473/287–292; D21/750
See application file for complete search history.

(56) References Cited

U.S. PATENT DOCUMENTS

| | | | | | |
|---|---|---|---|---|---|
| 3,975,023 | A * | 8/1976 | Inamori | 473/329 |
| 4,027,885 | A | 6/1977 | Rogers | |
| 4,077,632 | A | 3/1978 | Taylor | |
| 4,558,505 | A | 12/1985 | Moore | |
| 4,630,826 | A * | 12/1986 | Nishigaki et al. | 473/329 |
| 4,768,787 | A | 9/1988 | Shira | |
| 5,016,883 | A * | 5/1991 | Kobayashi | 473/347 |
| 5,154,425 | A * | 10/1992 | Niskanen et al. | 473/342 |
| 5,303,922 | A * | 4/1994 | Lo | 473/330 |
| 5,354,059 | A | 10/1994 | Stuff | |
| 5,417,419 | A * | 5/1995 | Anderson et al. | 473/329 |
| 5,487,543 | A | 1/1996 | Funk | |
| 5,620,382 | A * | 4/1997 | Cho et al. | 473/331 |
| 5,704,849 | A | 1/1998 | Schmidt et al. | |
| 5,749,795 | A | 5/1998 | Schmidt et al. | |
| 5,776,010 | A | 7/1998 | Helmstetter et al. | |
| 5,921,869 | A | 7/1999 | Blough et al. | |
| 5,971,868 | A | 10/1999 | Kosmatka | |
| 6,045,455 | A | 4/2000 | Kosmatka | |
| 6,059,670 | A | 5/2000 | Mogan | |
| 6,186,905 | B1 | 2/2001 | Kosmatka | |
| 6,193,615 | B1 | 2/2001 | Hirota | |
| 6,210,290 | B1 | 4/2001 | Erickson et al. | |
| 6,723,279 | B1 * | 4/2004 | Withers et al. | 419/27 |
| 7,083,531 | B2 | 8/2006 | Aguinaldo et al. | |
| 7,112,148 | B2 | 9/2006 | Deshmukh | |
| 7,144,336 | B2 | 12/2006 | Reyes et al. | |
| 7,179,175 | B2 | 2/2007 | Kennedy, III | |
| 7,326,126 | B2 | 2/2008 | Holt et al. | |
| 7,338,387 | B2 | 3/2008 | Nycum et al. | |
| 7,338,389 | B2 | 3/2008 | Wieland et al. | |
| 7,452,283 | B2 | 11/2008 | Hettinger et al. | |
| 7,473,187 | B2 | 1/2009 | Vokey et al. | |
| 7,780,548 | B2 * | 8/2010 | Solheim | 473/330 |
| 7,798,917 | B2 * | 9/2010 | Nguyen et al. | 473/330 |
| 7,819,756 | B2 * | 10/2010 | Ban et al. | 473/330 |
| 7,824,279 | B2 * | 11/2010 | Ban et al. | 473/331 |
| 7,922,601 | B2 * | 4/2011 | Ban et al. | 473/330 |
| 7,922,604 | B2 * | 4/2011 | Roach et al. | 473/350 |
| 2004/0014533 | A1 * | 1/2004 | Joo et al. | 473/340 |
| 2009/0011852 | A1 * | 1/2009 | Solheim et al. | 473/331 |

* cited by examiner

*Primary Examiner* — Sebastiano Passaniti
(74) *Attorney, Agent, or Firm* — Michael A. Catania; Rebecca Hanovice; Sonia Lari

(57) ABSTRACT

The present invention provides a method of manufacture and design such that very small detail features can be produced within the groove profile on an iron or wedge. The advantage in being able to do this is that spin will be enhanced for a variety of shot types and conditions when striking a golf ball with cover composed of a urethane-based material.

1 Claim, 5 Drawing Sheets

IRON-TYPE GOLF CLUB HEAD WITH GROOVE PROFILE IN CERAMIC FACE

CROSS REFERENCES TO RELATED APPLICATIONS

The Present Application claims priority to U.S. Provisional Patent Application No. 61/224,821, filed on Jul. 10, 2009, which is hereby incorporated by reference in its entirety.

STATEMENT REGARDING FEDERALLY SPONSORED RESEARCH OR DEVELOPMENT

Not applicable

BACKGROUND OF THE INVENTION

1. Field of the Invention

The present invention relates to a golf club head. More specifically, the present invention relates to a golf club head having a plurality of grooves.

2. Description of the Related Art

The prior art discloses various methods to manufacture golf club heads, especially iron-type golf club heads. For example, Rogers, U.S. Pat. No. 4,027,885 for Golf Iron Manufacture, discloses scoring grooves into a face for the club head.

Taylor, U.S. Pat. No. 4,077,632 for a Lined Face For A Golf Club discloses grooves in compliance with the Rules of Golf at that time.

Moore, U.S. Pat. No. 4,558,505, for a Method Of Making Weighted Metal Golf Club Head discloses at process for making an iron-type golf club head.

Shira, U.S. Pat. No. 4,768,787, for a Golf Club Including High Friction Striking Face discloses grit blasting the horizontal grooves to provide a friction generating surface when the striking surface of the golf club head engages a ball.

Stuff, U.S. Pat. No. 5,354,059, for Golf Club Heads With Means For Imparting Corrective Action, discloses a club head with at least two non-parallel sets of grooves.

Funk, U.S. Pat. No. 5,487,543, for a Shot Peened Golf Club Head, discloses shot peening the striking surface of a golf club head.

Mogan, U.S. Pat. No. 6,059,670, for a Golf Club Having A Head With A Hard Multilayer Striking Surface And Method For Making The Same, discloses manufacturing a club head by heat treatments, vacuum treatments, and roughening.

Doolen, U.S. Pat. No. 6,179,725, for a Golf Club Having Angular Grooves discloses grooves oriented at various angles.

Hirota, U.S. Pat. No. 6,193,615, for a Head Of Golf Clubs That Spins More, discloses a face having grooves that allow for pressure to act specially on the edges of the grooves to increase ball spin.

Vokey et al, U.S. Pat. No. 7,473,187, for Spin Milled Grooves For A Golf Club, discloses machining grooves into a face.

Hettinger et al., U.S. Pat. No. 7,452,283, for a Putterhead With Dual Milled Face Pattern, discloses milling grooves into a face of a putter.

Kennedy, III, U.S. Pat. No. 7,179,175, for a Golf Club Having Stepped Grooves, discloses a golf club head with V-shaped and U-shaped grooves.

Scoreline designs generally have a cross-section geometry that includes two edges, two side walls and a bottom. The side walls are at a predetermined angle from a vertical line. Usually, each wall has more than one section and those sections are straight or curved. Alternatively, the scoreline design is a "V" shape, in which case there is no bottom other than a vertex or fillet radius.

Iron-type golf clubs having scorelines with sharp edges and relatively vertical side walls are advantageous to golfers since such sharp edged grooves allow golfers to induce higher levels of spin on a ball struck with such an iron-type golf club having sharp edged grooves. Iron-type golf clubs without sharp edged grooves or essentially vertical side walls will induce less spin when impacting a golf ball, especially higher-lofted (40 degrees +) golf clubs.

Backspin is the primary mechanism by which a golfer can control a golf ball upon landing after being struck. Backspin is especially important for short shots where proximity to the hole is of greater consequence to the golfer. High lofted clubs (50 degrees to 75 degrees) have grooves designs which are meant to interact with the surface of a golf ball at impact and remove debris from the contacting surface in order to increase friction and thereby impart more spin on the ball.

Existing materials and processes are not amenable to precision control of groove profile. Forging, casting and machining of metals all have practical limitations with regard to the feature size that can be accurately and consistently replicated in mass production. Features on the order of 0.001 inch or less within the groove (as opposed to on the land on the land between grooves) are not suitable for existing methods of manufacture using conventional materials such as stainless steel, carbon steel, titanium, aluminum and the like.

The Rules of Golf as interpreted by the United States Golf Association ("USGA") have constrained the types of scoreline patterns that may be used on golf clubs.

BRIEF SUMMARY OF THE INVENTION

The present invention seeks to accomplish a method of manufacture and design such that very small detail features can be produced within the groove profile on an iron or wedge. The advantage in being able to do this is that spin will be enhanced for a variety of shot types and conditions when striking a golf ball with cover composed of a urethane-based material.

The present invention consists of small features on the outermost edge of a groove. The features are formed in a ceramic material, most preferentially made via injection molding using a fine particulate ceramic formulation to enhance replication of fine details. The small features consist of micro-edges which will increase engagement with the ball during impact, causing increased spin on the ball. The features are precision machined in a negative tool surface and the ceramic material is formed against the tool surface.

An object of the present invention is a novel groove profile in a ceramic face insert intended to enhance backspin.

One aspect of the present invention is an iron-type golf club head having a body having a face insert composed of a ceramic material and a plurality of grooves located on the face insert having micro-edges.

Another aspect of the present invention is an iron-type golf club head having a body having a face insert composed of a ceramic material and a plurality of grooves located on the face insert with each groove having a Y-shape cross-section with micro-edges.

Another aspect of the present invention is an iron-type golf club head having a body having a face insert composed of a ceramic material and a plurality of grooves located on the face insert with each groove having a length L3 of 0.003 inch, a length L4=0.005 inch, an angle θ1 of seven degrees, an angle θ2 of fourteen degrees, and an angle θ3 of fifty degrees.

Another aspect of the present invention is an iron-type golf club head having a body having a face insert composed of a ceramic material and a plurality of grooves located on the face insert with each groove having a length L2 of 0.004 inch, and length L1 of 0.005 inch.

Another aspect of the present invention is an iron-type golf club head having a body having a face insert composed of a ceramic material and a plurality of grooves located on the face insert with each groove having a radius R2 of 0.002 inch, a radius R3 of 0.002 inch and a length L2 of 0.004 inch.

Another aspect of the present invention is an iron-type golf club head having a body having a face insert composed of a ceramic material and a plurality of grooves located on the face insert with each groove having a radius R1 of 0.010 inch, a length, L2 of 0.004 inch, and an angle θ1 of seven degrees.

Another aspect of the present invention is an iron-type golf club head having a body having a face insert composed of a ceramic material and a plurality of grooves located on the face insert with each groove having a plurality of micro-edges within a zone zone between a circle of radius 0.010 inch and a concentric circle of radius 0.011 inch.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
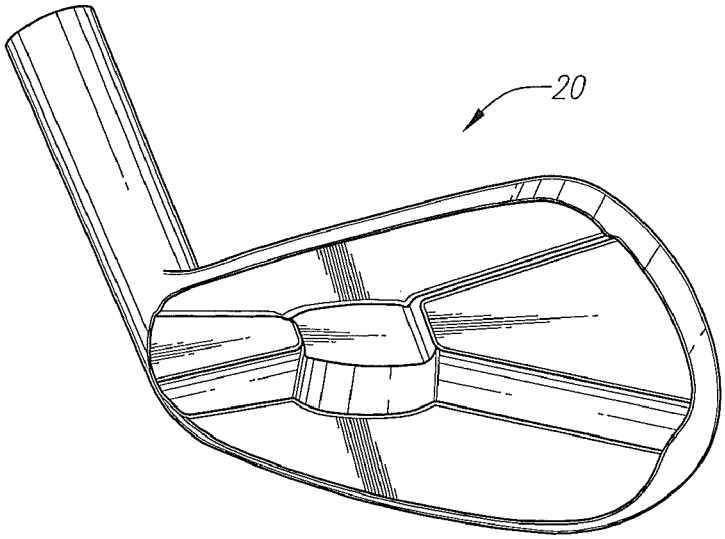
FIG. 1 is a perspective view of an iron-type golf club head.
Figure 2:
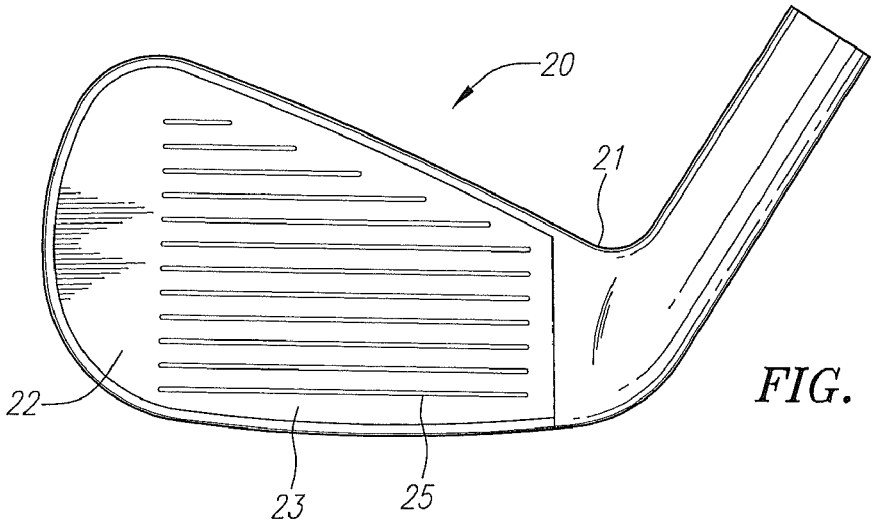
FIG. 2 is a front view of an iron-type golf club head.
Figure 3:
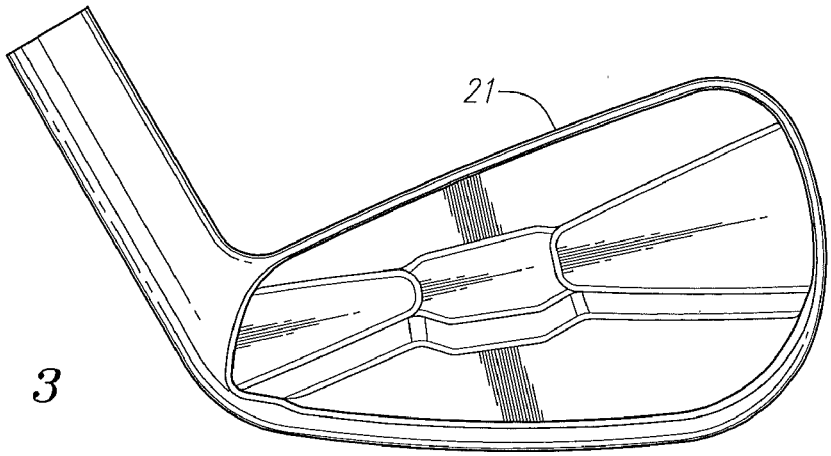
FIG. 3 is a rear view of an iron-type golf club head.
Figure 4:
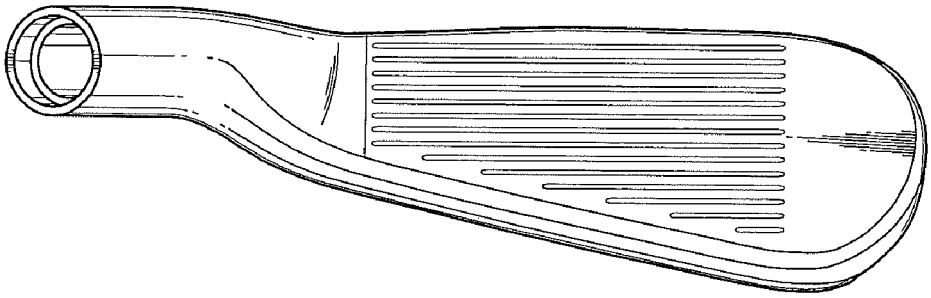
FIG. 4 is a top plan view of an iron-type golf club head.
Figure 5:
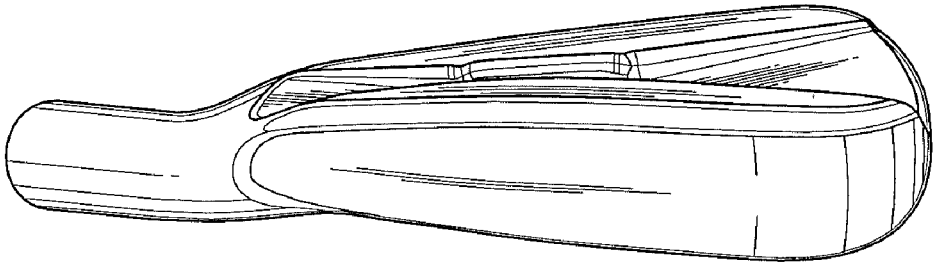
FIG. 5 is a bottom plan view of an iron-type golf club head.
Figure 6:
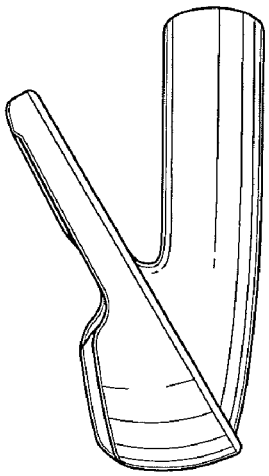
FIG. 6 is a toe side view of an iron-type golf club head.
Figure 7:
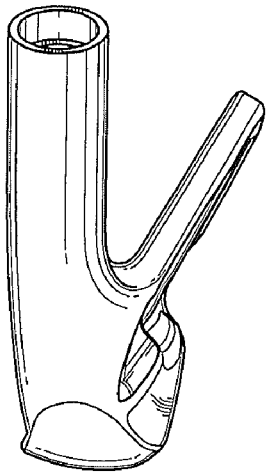
FIG. 7 is heel side view of an iron-type golf club head.

As shown in FIGS. 1 and 3-7, an iron-type golf club is generally designated 20. The golf club head 20 includes a body 21 having a face 22 with a surface 23 and a plurality of grooves 25. The body 21 is preferably composed of a material such as titanium materials, stainless steel, carpenter steel, 1020 steel, amorphous metals and the like. The material of the body 21 preferably has a density between 4 g/cm$^3$ and 10 g/cm$^3$. Such titanium materials include pure titanium and titanium alloys such as 6-4 titanium alloy, 6-22-22 titanium alloy, 4-2 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. The body 21 is preferably manufactured through casting. Alternatively, the body 21 is manufactured through forging, forming, machining, powdered metal forming, metal-injection-molding, electro-chemical milling, and the like.

Alternatively, the structure of the iron-type golf club is such as disclosed in Helmstetter, et al., U.S. Pat. No. 5,776,010, which is hereby incorporated by reference in its entirety.

Alternatively, the structure of the iron-type golf club is such as disclosed in Schmidt, et al., U.S. Pat. No. 5,749,795, which is hereby incorporated by reference in its entirety.

Alternatively, the structure of the iron-type golf club is such as disclosed in Schmidt, et al., U.S. Pat. No. 5,704,849, which is hereby incorporated by reference in in its entirety Alternatively, the structure of the iron-type golf club is such as disclosed in Blough et al., U.S. Pat. No. 5,921,869, which is hereby incorporated by reference in its entirety.

Alternatively, the structure of the iron-type golf club is such as disclosed in Kosmatka, U.S. Pat. No. 5,971,868, which is hereby incorporated by reference in its entirety.

Alternatively, the structure of the iron-type golf club is such as disclosed in Kosmatka, U.S. Pat. No. 6,045,455, which is hereby incorporated by reference in its entirety.

Alternatively, the structure of the iron-type golf club is such as disclosed in Kosmatka, U.S. Pat. No. 6,186,905, which is hereby incorporated by reference in its entirety.

Alternatively, the structure of the iron-type golf club is such as disclosed in Erickson, et al., U.S. Pat. No. 6,210,290, which is hereby incorporated by reference in its entirety.

Alternatively, the structure of the iron-type golf club is such as disclosed in Reyes, et al., U.S. Pat. No. 7,144,336, which is hereby incorporated by reference in its entirety.

Alternatively, the structure of the iron-type golf club is such as disclosed in Deshmukh, U.S. Pat. No. 7,112,148, which is hereby incorporated by reference in its entirety.

Alternatively, the structure of the iron-type golf club is such as disclosed in Aguinaldo, et al., U.S. Pat. No. 7,083,531, which is hereby incorporated by reference in its entirety.

Alternatively, the structure of the iron-type golf club is such as disclosed in Wieland, et al., U.S. Pat. No. 7,338,389, which is hereby incorporated by reference in its entirety.

Alternatively, the structure of the iron-type golf club is such as disclosed in Nycum, et al., U.S. Pat. No. 7,338,387, which is hereby incorporated by reference in its entirety.

Figure 8:
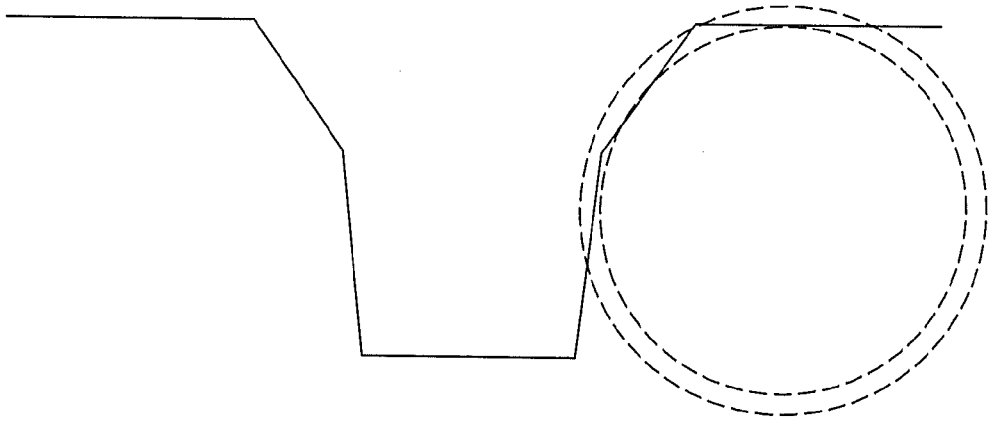
FIG. 8 is an enlarged cross-sectional view of a groove of the present invention with dashed line circles to demonstrate the profile.
Figure 9:
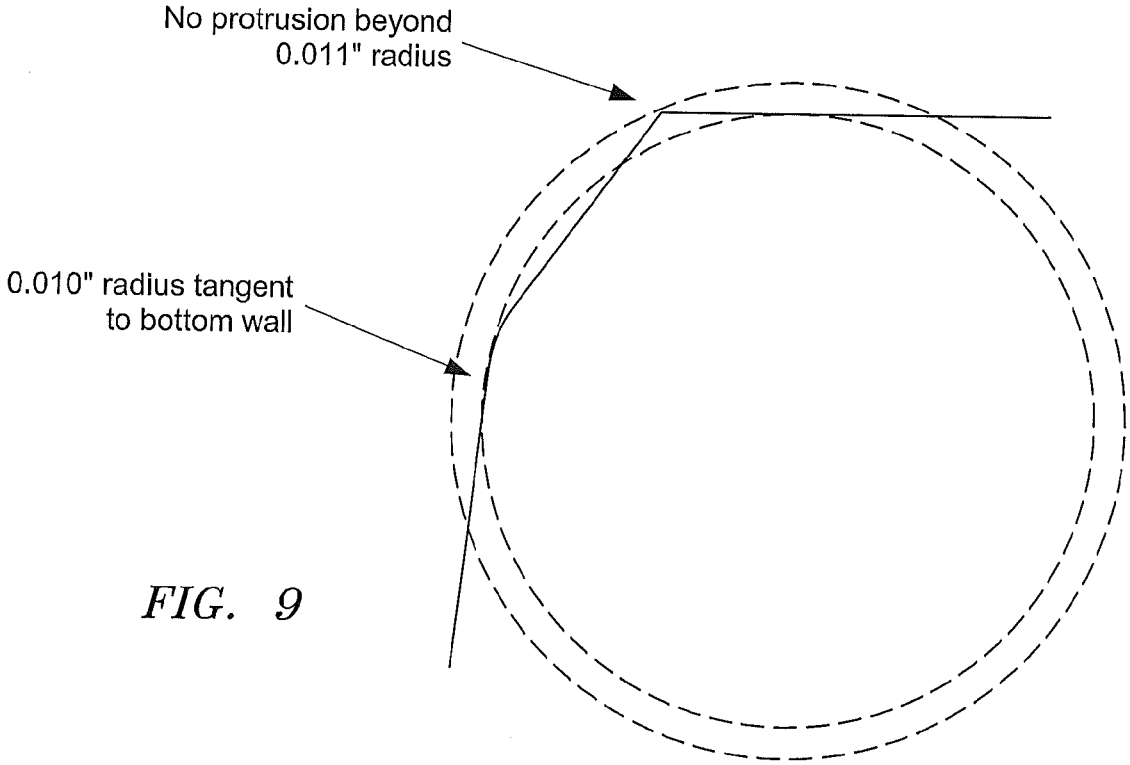
FIG. 9 is an enlarged cross-sectional view of a portion of a groove of the present invention with dashed line circles to demonstrate the profile.
Figure 10:
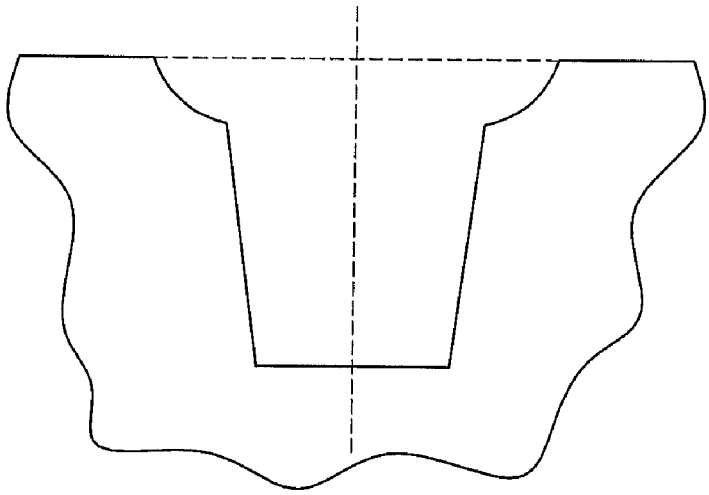
FIG. 10 is a cross-sectional view of a groove of the present invention.

Alternatively, the structure of the iron-type golf club is such as disclosed in Holt, et al., U.S. Pat. No. 7,326,126, which is hereby incorporated by reference in its entirety As shown in FIGS. 8 and 9, the detail features are such that they are preferably contained within a zone between a circle of radius 0.010 inch and a concentric circle of radius 0.011 inch.

Figure 11:
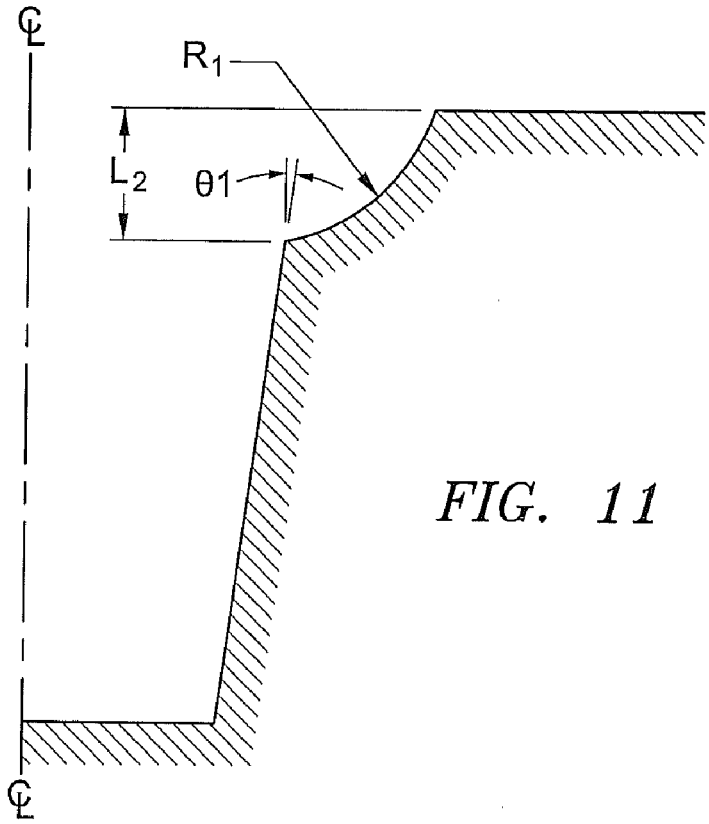
FIG. 11 is an enlarged cross-sectional view of a portion of an alternative groove profile of the present invention.

As shown in FIG. 11, radius, R1=0.010 inch, length, L2=0.004 inch and angle θ1=7 degrees.

Figure 12:
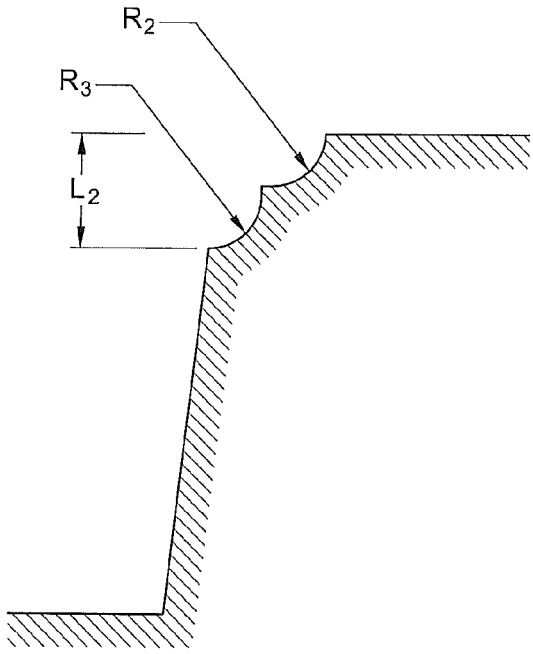
FIG. 12 is an enlarged cross-sectional view of a portion of an alternative groove profile of the present invention.

As shown in FIG. 12, radius R2=0.002 inch, radius R3=0.002 inch and length L2=0.004 inch.

Figure 13:
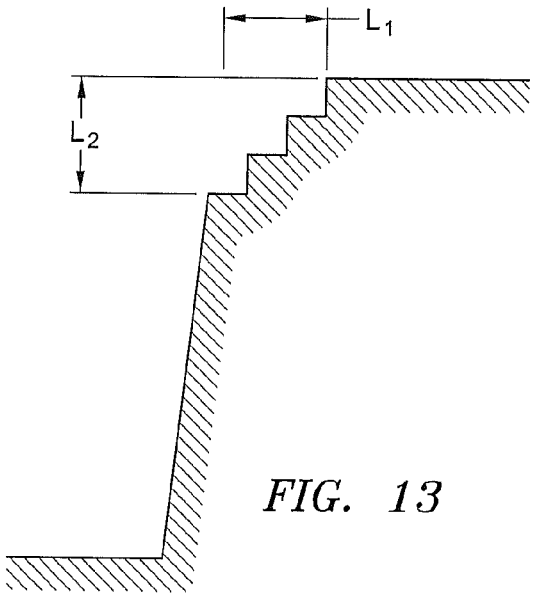
FIG. 13 is an enlarged cross-sectional view of a portion of an alternative groove profile of the present invention.

As shown in FIG. 13, length L2=0.004 inch, and length L1=0.005 inch.

Figure 14:
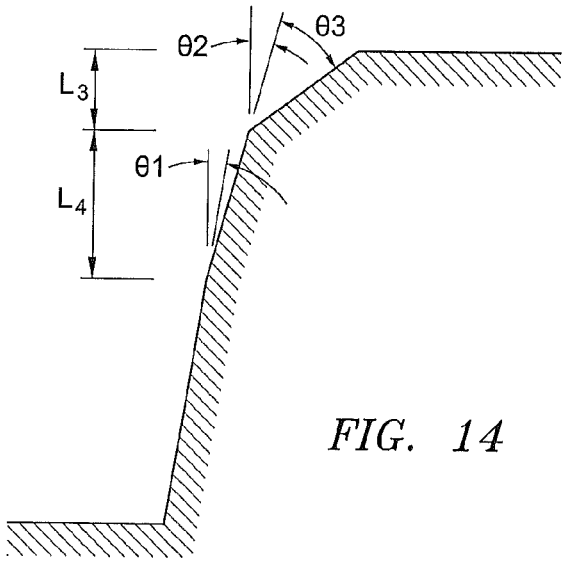
FIG. 14 is an enlarged cross-sectional view of a portion of an alternative groove profile of the present invention.

As shown in FIG. 14, L3=0.003 inch, length L4=0.005 inch, angle θ1=7 degrees, angle θ2=14 degrees, angle θ3=50 degrees.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. An iron-type golf club head comprising:

a body having a face insert composed of a ceramic material, the body composed of a stainless steel or titanium alloy material; and a plurality of grooves located on the face insert, each groove of the plurality of grooves having micro-edges within a zone between a circle of radius 0.010 inch and a concentric circle of radius 0.011 inch, each of the micro-edges has a length L2 of 0.004 inch and consists of a first curvature with a radius R3 of 0.002 inch and a second curvature with a radius R2 of 0.002 inch, wherein the second curvature is adjacent an edge surface of the face insert and the first curvature is adjacent a side wall of the groove.

* * * * *